US005244358A

United States Patent [19]

Mollo

[11] Patent Number: 5,244,358

[45] Date of Patent: Sep. 14, 1993

[54] LOAD SENSED VARIABLE OUTPUT GEAR PUMP

[76] Inventor: James R. Mollo, 209 Julrich Ave., McMurray, Pa. 15317

[21] Appl. No.: 784,388

[22] Filed: Oct. 29, 1991

Related U.S. Application Data

[63] Continuation-in-part of Ser. No. 426,750, Oct. 24, 1989, abandoned, which is a continuation-in-part of Ser. No. 211,163, Jun. 22, 1988, abandoned, which is a continuation-in-part of Ser. No. 8,313, Jan. 29, 1987, abandoned.

[51] Int. Cl.[5] ..... F04B 49/00

[52] U.S. Cl. ..... 417/310; 417/304

[58] Field of Search ..... 417/302, 303, 304, 310; 137/596.13

[56] References Cited

U.S. PATENT DOCUMENTS

| | | | |
|---|---|---|---|
| 3,379,133 | 4/1968 | McCormick | 417/304 |
| 3,828,813 | 8/1974 | Haussler | 137/596.13 |
| 4,040,438 | 8/1977 | Wilke | 137/596.13 |
| 4,122,865 | 10/1978 | Budzich | 137/596.13 |
| 4,520,902 | 6/1985 | Snow | 417/304 |
| 4,798,126 | 1/1989 | Budzich | 137/596.13 |
| 5,048,396 | 9/1991 | Torkler et al. | 137/599.2 |

*Primary Examiner*—Richard A. Bertsch
*Assistant Examiner*—Alfred Basichas
*Attorney, Agent, or Firm*—Webb, Burden, Ziesenheim & Webb

[57] ABSTRACT

A load sensed variable output gear pump having adjustable high pressure compensation, tuneable response, low unloading pressure and variable pressure drop adjustability. It comprises a unitary housing enclosing a pump which pumps through a main inlet-outlet passage which by-passes through a fixed control and a variable control to an outlet passage leading to a reservoir. An overload control may also be used connected to an inlet load sensing passage which tends to close said fixed and variable controls.

3 Claims, 1 Drawing Sheet

LOAD SENSED VARIABLE OUTPUT GEAR PUMP

RELATED APPLICATIONS

This application is a continuation-in-part of application Ser. No. 07/426,750, filed Oct. 24, 1989, which is a continuation-in-part of application Ser. No. 07/211,163, filed Jun. 22, 1988, which is a continuation-in-part of application Ser. No. 07/008,313, filed Jan. 29, 1987, all now abandoned.

This invention relates to a load-sensed, variable output gear pump and, more particularly, one with adjustable high pressure compensation, tuneable response, low unloading pressure and variable pressure drop adjustability.

BACKGROUND OF THE INVENTION

Although various manufacturers of hydraulic valves have produced valves containing hydrostats, they have chosen to make these hydrostats fixed and not variable. The reason they are fixed is that the values or pressure drops are known and can be controlled by the manufacturer for the specific valve. This, however, locks the manufacturer of such valve as the sole supplier for any type of load sensed, fixed displacement system.

SUMMARY OF THE INVENTION

An object of the invention is to overcome the above-named disadvantage of a fixed hydrostat and, instead, provide a novel load-sensed variable output fixed displacement pump which will allow any valve manufacturer to compete, as the control is within the pump. Also, within the pump is a low pressure unload control which will discharge all flow to reservoir at a low pressure drop when a standard control valve is in the neutral position.

A more specific object of the invention is to provide a load-sensed variable output gear pump with adjustable high pressure compensation, tuneable response, low unloading pressure and variable pressure drop adjustability.

Figure 1:
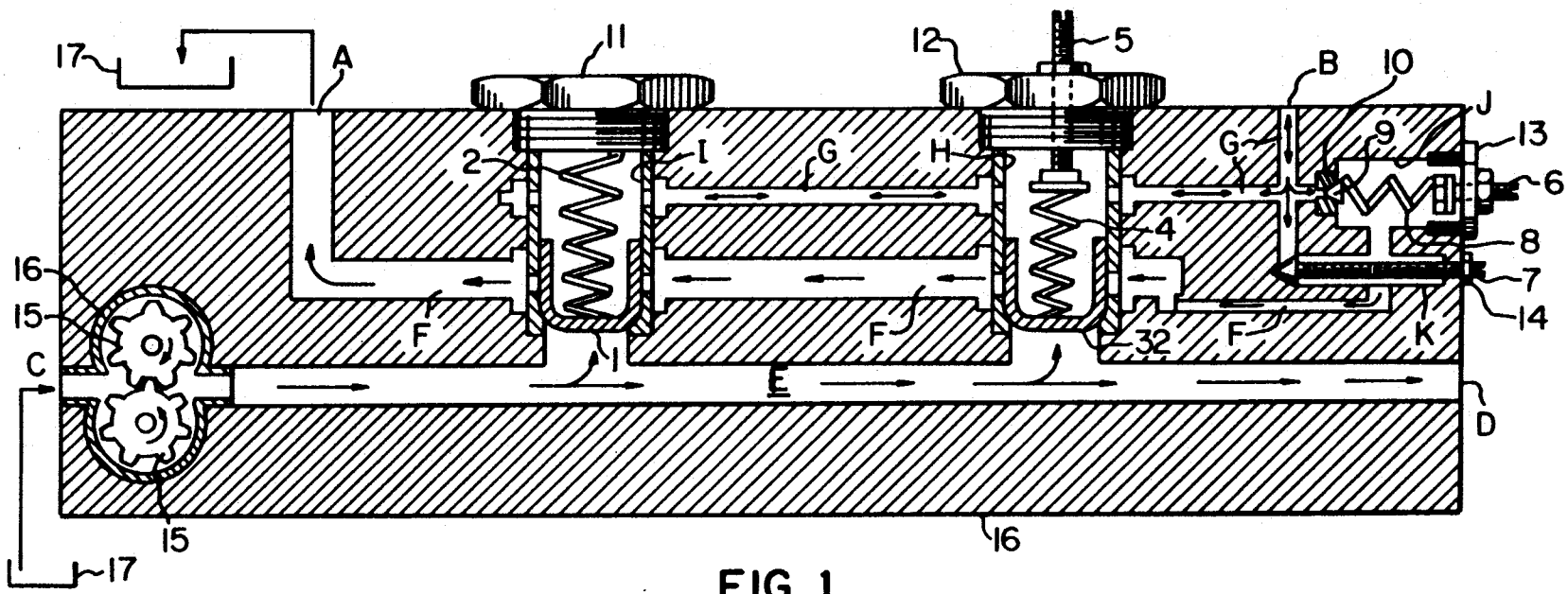
FIG. 1 is a cross-section of the complete pump embodying the present invention.

Referring more particularly to FIG. 1 there is shown a constant displacement pump that will vary the output flow in reference to an adjustable pressure drop across one or more, variable or fixed, compensated or noncompensated orifices.

The pump operates as follows:

In the neutral condition, the control valve or valves 19 will be in a P pressure blocked with X and Y to reservoir 17. This neutral condition is shown in FIG. 1 and schematically in FIG. 2. As the gears 15 are turned, hydraulic fluid is directly pulled from the reservoir 17, through port C. The fluid will be discharged from the gears 15, to passage E and out port D to an appropriate valve bank and deadheaded. Spring 2, in control 11, will begin to be depressed by poppet 1. At a low pressure 30 to 40 psi, fluid will enter passage F and continue through port A to the reservoir 17. Fluid at this time cannot pass from passage E to F through control 12, a standard hydrostat with a 1 to 1 effective area ratio, as the spring tension 4, is adjustable in a range of 60 to 300 psi and holding poppet 32 in the closed position. At this time, all flow produced by the gear pump is going to the reservoir 17 at a low pressure drop. As no flow is present past the P blocked position in the valves, the load sense port B, feels only reservoir pressure in passage G and, in turn, chamber I of control 11 and chamber H of control 12. Control 11 has a 2 to 1 effective area ratio in regards to chamber I and passage E. The unbalanced areas allow spring 2 to be a light rate.

Figure 2:
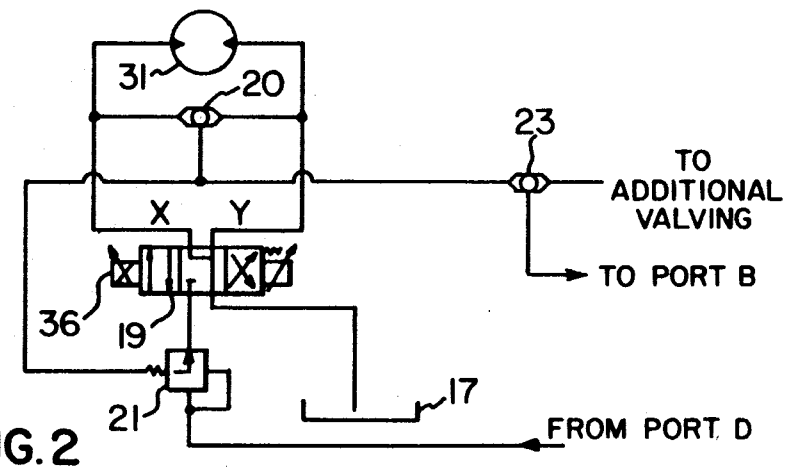
FIG. 2 is a schematic showing of a typical load which, per se, forms no part of the present invention.

Referring to FIG. 2, wherein standard parts are illustrated schematically, and which assembly, per se, forms no part of the present invention, valve 19 is a proportional control valve which is pressure compensated by valve 21. Valve 20 is a shuttle valve giving an alternative signal in relation to load activation as an output signal from the load or actuator to the controller or, in this case, the pump 16. As power is applied to solenoid 36, valve 19 is shifted to the right allowing flow passage P to flow over the compensator valve 21 through valve 19, and to the motor, 31. The amount of load pressure is transmitted through the shuttle valve 20 to shuttle valve 23. Shuttle valve 23 transmits the load pressure to the pump 16, entering port B. Port B transmits the pressure through passage G to chamber H in control 12, chamber I in control 11, to control 14 screw 7, and control 13 poppet 9. As soon as any positive pressure is exerted on chamber I, control 11 closes, stopping flow from passage E to passage F across control 11. As control 11 closes, control 12 begins to open passage E to passage F modulating the flow and bypassing only enough fluid to maintain a prescribed pressure drop. This pressure drop is variable for multi valve use and is regulated via screw 5 which controls the set tension on spring 4 in control 12. As passage G senses load pressure and this pressure is applied to chamber H of control 12, the total pressure in passage E would be spring tension plus load pressure.

If the pump output flow, due to down stream restrictions in the piping or the control valve assembly 19, is not sufficient, the spring tension can be increased by adjusting screw 5 on control 12. Pressure would increase with load until the setting on control 13 was reached. At a predetermined and adjustable pressure, poppet 9 would lift off seat 10 allowing flow from passage G to chamber J. The high pressure is set by screw 6 changing the tension on spring 8 in control 13. This offsets the balance pressure in chamber H allowing more flow to passage F from passage E keeping the pressure from exceeding the preset valve in control 13. If the controlled response is too fast, control 14 can be adjusted by turning screw 7, causing a control response lag via controlled leakage from passage G to passage K which is interconnected to passage F and the reservoir 17.

When valve 19 returns to the neutral condition, the pump 16 returns to the first mentioned condition.

The basic features of the present invention, namely the load sensed variable output gear pump, are as follows:

1. Low unloading pressure drop a. The low unloading pressure drop assures a minimum horse power draw in the neutral valve condition. As the pump is unloading directly off its own output, all piping restrictions and down stream line losses are ignored and not additive. If the valve or valves used to control a function or multiple of functions have a closed or open center neutral condition, the pump unload condition has such a low pressure drop that all fluid will be passed to the reservoir directly from the pump. This will occur on even an open centered valve as the inherent pressure drop on manufacturers valves will exceed the pump unload value causing the fluid to take the path of least resistance. This allows the pump to be used on open or closed center systems with at least a 50% horse power savings in the neutral condition.

2. Load sensing self contained and adjustable a. Adjustable load sensing allows the use of various manufacturers off the shelf components as opposed to special unloader valves. The ability to set the pressure drop in response to piping and valve restrictions gives the designer total flexibility and running horse power savings far in excess of those currently on the market with conventional load sense valves of the non-adjustable pressure drop type.

3. Adjustable compensation in regard to load a. The ability to run multiple functions at low load compensated or noncompensated while one or more functions are in the compensated or stall condition.

4. Tunable controlled response a. The ability to set the response time of the load unload function.

b. The ability to tune the response time of the valve or valves in reference to the load changers.

c. The ability to run a load sense circuit using alternative shuttle valves or open closed check valves in the load sense logic circuit with control lock-up.

A simplified modification of the invention is to completely eliminate or disengage overload control 13, such as by adjusting it as to nullify its presence. Only outlet G-B would remain effective in the right hand upper corner of FIG. 1.

Thus it will be seen that I have provided a novel integral pump having considerably versatility and efficiency under varying load conditions.

While I have illustrated and described several embodiments of my invention, it will be understood that these are by way of illustration only and that various changes and modifications may be contemplated in my invention and within the scope of the following claims:

I claim:

1. An integral housing enclosing a fluid delivery pump of the constant displacement type, said housing having a main inlet-outlet passage pressured by said pump, a fixed control and a variable control, a by-pass outlet passage connected to a reservoir, said fixed and variable controls controlling the flow through said by-pass outlet passage, said housing having inlet load sense passages, one interconnecting said fixed and variable controls in a manner to tend to close said controls and the other exiting from said variable control and housing to a load and reservoir, said fixed control being normally open when pressure is not applied to said load sense passages, allowing said main inlet-outlet passage to be connected to said by-pass outlet passage at a low pressure drop, said fixed control closing and shutting off flow from said by-pass outlet passage when any positive pressure enters said inlet load sense passages, said variable control being normally closed, allowing said main inlet-outlet passage to be closed to said by-pass outlet passage when pressure is not applied to said inlet load sense passages, said variable control including a variable tension, spring-pressed poppet allowing a metered flow from said main inlet-outlet passage to said by-pass outlet passage when a positive pressure enters said inlet load sense passages, maintaining the condition by adjusting said flow from said main inlet-outlet passage to said by-pass outlet passage in response to said spring tension plus the positive pressure induced by said inlet load sense passages.

2. Apparatus as recited in claim 1 together with an overload control connected to one of said inlet load sense passages and which is normally closed, having a variable tension, spring pressed poppet allowing flow from said inlet load sense passages to said by-pass outlet passage to occur when said inlet load sense passages reach a predetermined positive pressure unbalancing said variable control, allowing more flow to reservoir through said by-pass outlet, said overload control including a variable orifice for restricting flow through the other of said by-pass inlet load sense passages thereby dampening the response of said variable control and fixed control and said overload control by creating response lag due to by-pass flow regulated by flow through said variable orifice.

3. An integral housing enclosing a fluid delivery pump of the constant displacement, fixed delivery type, said housing having a main inlet-outlet passage, a fixed control and variable control, a by-pass outlet passage connected to a reservoir, said variable and fixed controls controlling the flow through said by-pass outlet passage, an overload control having a variable tuning orifice connected in parallel and common to said by-pass outlet passage, said housing having an inlet load sense passage interconnecting said fixed and variable controls, in a manner tending to close them, and with said overload control and variable tuning orifice, said fixed control being normally open when pressure is not applied to said load sense passage allowing said inlet-outlet passage to be connected to said by-pass outlet passage at a low pressure drop, said fixed control closing and shutting off flow from said inlet-outlet passage to said outlet passage when any positive pressure enters said inlet load sense passage, said variable control being normally closed, allowing said inlet-outlet passage to be closed to said by-pass outlet passage when pressure is not applied to said inlet load sense passage, said variable control including a variable tension spring-pressed poppet allowing a metered flow from said inlet-outlet passage to said outlet passage when a positive pressure enters said inlet load sense passage maintaining the condition by adjusting said flow from said inlet-outlet passage to said outlet passage in regards to said spring tension plus the positive pressure induced by said inlet load sense passage, said overload control being normally closed, said overload control having a variable tension spring-pressed poppet allowing flow from said inlet load sense passage to said by-pass outlet passage to occur when the said inlet load sense passage reaches a selected overload positive pressure unbalancing said variable control, allowing more flow from said inlet-outlet passage to said by-pass outlet passage maintaining the integrity of said variable control, said variable tuning orifice being restrictive, allowing flow from said by-pass inlet load sense passage to said outlet passage, dampening the response of said variable control and fixed control and said overload control by creating response lag due to by-pass flow regulated by flow over said variable tuning orifice control.

* * * * *